United States Patent [19]

DeLuish

[11] 4,036,312

[45] July 19, 1977

[54] WELL JAR

[75] Inventor: Kenneth R. DeLuish, Humble, Tex.

[73] Assignee: HYCALOG Inc., Houston, Tex.

[21] Appl. No.: 722,495

[22] Filed: Sept. 13, 1976

[51] Int. Cl.[2] ..... E21B 1/10

[52] U.S. Cl. ..... 175/302; 175/304

[58] Field of Search ..... 175/299, 300, 304, 302, 175/305

[56] References Cited

U.S. PATENT DOCUMENTS

| | | | |
|---|---|---|---|
| 2,101,968 | 12/1937 | Wickersham | 175/302 |
| 2,354,709 | 8/1944 | Shaffer | 175/304 |
| 2,474,459 | 6/1949 | Beck | 175/304 |
| 2,550,142 | 4/1951 | Dumble | 175/304 |
| 3,658,140 | 4/1972 | Berryman | 175/304 |
| 3,963,081 | 6/1976 | Anderson et al. | 175/304 |

*Primary Examiner*—James A. Leppink

*Attorney, Agent, or Firm*—Arnold, White & Durkee

[57] ABSTRACT

A well jar is characterized by inner and outer telescoped members held from relative displacement by a latching member having an extending portion thereon. Imposition of an axially directed triggering force exceeding a predetermined magnitude is transmitted against the biasing force of a resilient member through a force transmitting arrangement to a latch release member provided with an opening therein sized to receive the extending portion of the latching member. The release member rotates in a predetermined angular direction to come into registry with the opening therein to receive the extending portion of the latching member as the latching member displaces radially outwardly to release the inner member. Upon release, the inner member responds to the axially directed force to drive impact surfaces disposed on the inner and outer members into an impact-producing engagement.

32 Claims, 8 Drawing Figures

FIG. 1 C
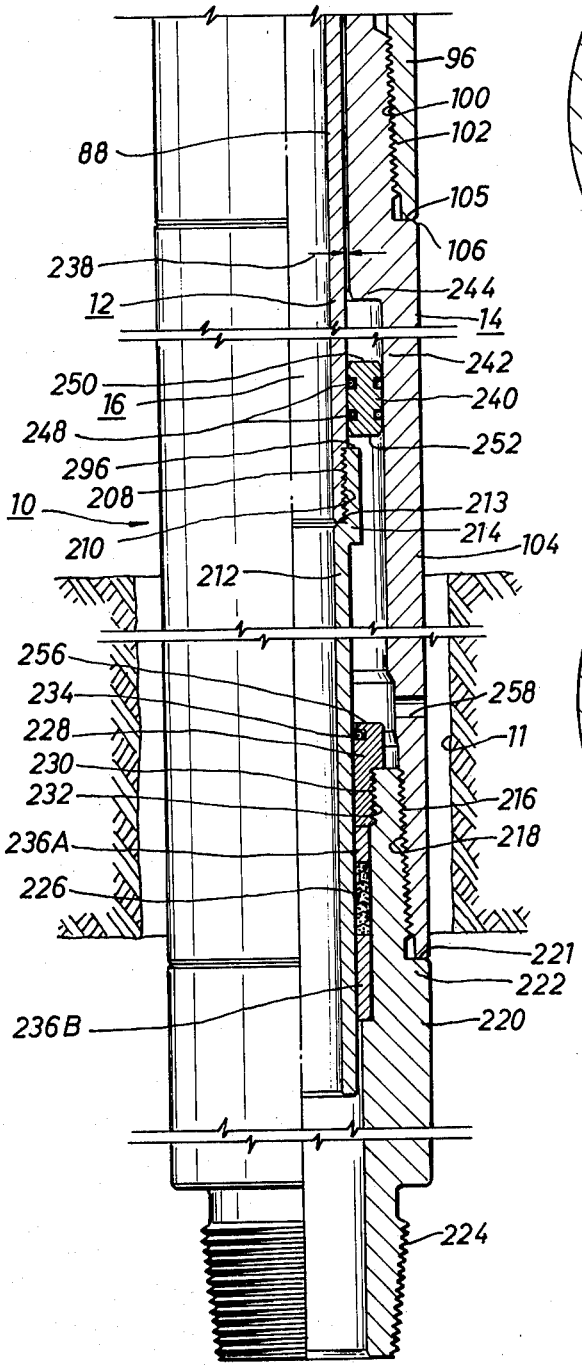
FIG. 2
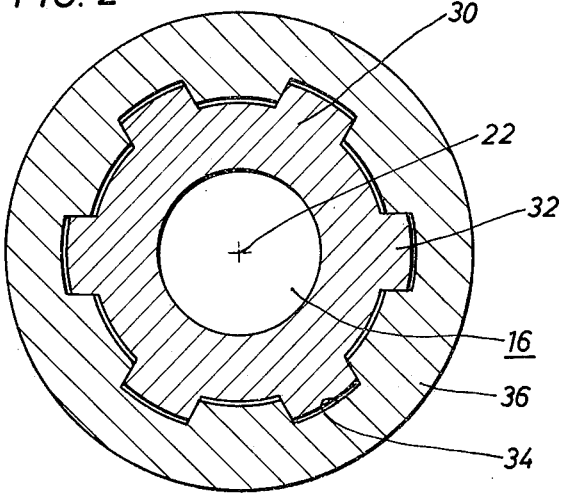
FIG. 3A
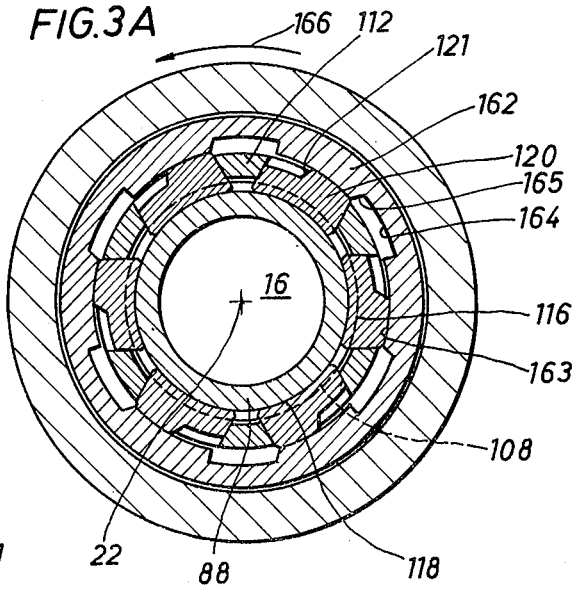
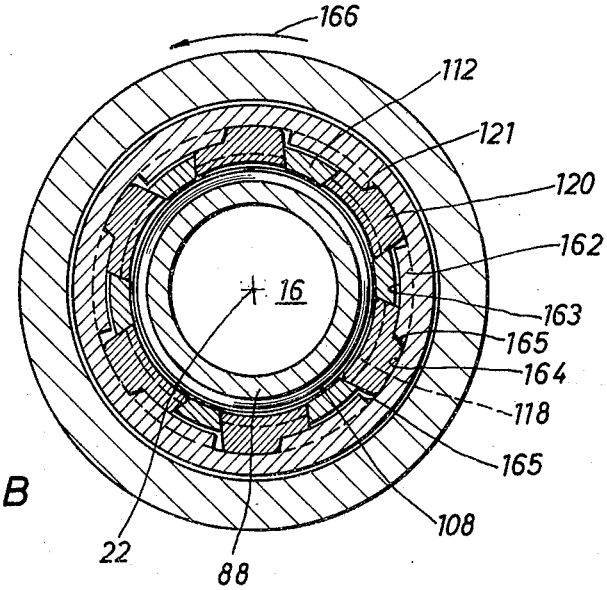
FIG. 3B

WELL JAR

BACKGROUND OF THE INVENTION

1. Field of the Invention

This invention relates to well tools and in particular, a well jar tool utilizing both rotational and radical displacement of latch components to initiate release of a latching member.

2. Description of the Prior Art

During drilling operations in certain situations or when encountering certain geological conditions, it sometimes occurs that devices, such as drill bits or other equipment related to drilling operations, connected within the drill string become engaged within the well bore and rotational axial movement of the drill string in either an advancing or retracting direction is prevented.

For this eventuality the prior art has disposed within the drill string a device known in the art as a well jar which serves to impart a substantial impactive force to the device engaged within the bore to effectuate the release thereof from its engaged position.

Several of the prior art jarring arrangements are operable in one axial direction only, thus necessitating the disposition in the drill string of two separate tools, one adapted for imposing a downward or "bumping" force on the engaged device, while the other is operable to impart an upward, or "jarring" force, on the engaged device. Of necessity such prior art devices require that a safety joint, or security device of some known type, be provided between the bumping and jarring tools. Despite the provision of such a joint, the possibility remains opens that disengagement of the adjacent tools could occur. Also, such tools deliver insufficient force to effectively disengage the engaged device and are, for these reasons, disadvantageous.

Other jars known in the art are able to alternatively transmit either a bumping or jarring force and eliminate the necessity of a safety joint by providing telescopically disposed inner and outer members normally latched in a neutral position and actuated by suitable tripping devices so as to bring surfaces thereon into impact-producing engagement upon release of the latching member. Typically, such jars utilize either exclusively rotational or radially outwardly displacement of the latching member to release the inner and outer members as the impact producing, or triggering, force is imposed thereupon. However, such jars are deficient in that the rotational or radially outwardly disengagement of the latching member requires gradual disengagement of the latching member from the member to which it is latched. As a corollary, as the force imposed on the latched member increases, the area of engaged contact between the latching and latched members necessarily decreases. Such a situation, whether in purely rotational or purely radially outwardly directed latching release, leads to the increased possibility of wear and premature failure of the latching member of prior art well jars.

It is therefore advantageous to provide a well jar which combines both rotational and radially outwardly movement of cooperatively arranged members so that the latching member is maintained in full engagement with a latched member of the jar until a full predetermined magnitude of the impact-producing force is imposed upon the jar. Thus, at only that instant does the disengagement of the latching member occur to thereby eliminate the wearing of parts resulting from gradual disengagement.

It is also advantageous to provide a well jar having a radially outwardly movable latching member and rotatably movable release member cooperating such that rotation of the release member places in registration an opening in the release member with the latching member. Thus, the simultaneous disengagement of the latching member and radially outwardly engagement of the latching member and the release member permits the parts of the jar to telescopically displace relative to the other to impact surfaces thereon to produce a disengaging impact. Further, it is advantageous to provide a well jar wherein rotation of the release member is occasioned by overlapped camming surfaces disposed both on the release member and an associated cam member in order to initiate rotation of the release member when a suitable force is transmitted thereinto so as to place in radial registration an opening in the release member with an extending portion disposed on the latching member. Of course, by overlapped, it is herein meant that the defined camming surfaces are engaged in a camming relationship along a camming interface.

SUMMARY OF THE INVENTION

A well jar embodying the teachings of this invention comprises concentrically disposed inner and outer members, each having two impact surfaces thereon spaced apart a predetermined axial distance. A latching member having a plurality of lands thereon engages radial grooves provided on the inner member to prevent relative motion between the inner and outer members. A resilient ring spring permits the engaged latching and inner members to respond only to a triggering force exceeding a predetermined spring bias. The imposition of such a predetermined force acting in an axial direction on the inner member is transmitted through the latching member and through a force transmitting arrangement into a latch release member. The release member responds by rotating in a predetermined angular direction about overlapping cammed surfaces to place a longitudinal groove provided in the release member in radial registration with an extending portion provided on the latching member. The engaged radial grooves and lands have inclined surfaces thereon which act to urge the latching member radially outwardly away from the locked disposition when an axial force is imposed upon the inner member. The latching member responds by displacing radially outwardly to simultaneously engage the extending portion thereon with the opening or longitudinal groove provided in the release member. Such engagement unlocks the inner member from the latch member and the inner member responds by axially displacing to drive one of the impact surfaces on the inner member into impact-producing contact with the impact surface disposed on the outer member. A torsion reset spring is provided to urge the inner and latching members to re-engage into a locked position after release of the axially directed trigger force from the inner member. The jar is operable by either a tensile or a compressive force imposed on the inner member. The jar thus combines rotational and radially outward movement of the latching and release member to maintain full engagement of the latching member until the release member rotates into registry therewith to eliminate wearing of parts resulting from gradual disengagement.

BRIEF DESCRIPTION OF THE DRAWINGS

The invention will be more fully understood from the following detailed description, taken in connection with the accompanying drawings, in which:

FIGS. 1A, 1B, and 1C are longitudinal elevational views, partially in section, showing a well jar embodying the teachings of this invention;

FIG. 2 is a sectional view taken along lines II-II of FIG. 1A;

FIGS. 3A and 3B are sectional views taken along lines III—III in FIG. 1B, and illustrate the latch release means embodied within the invention in its unactuated and actuated positions, respectively;

DESCRIPTION OF THE PREFERRED EMBODIMENT

Figure 1A:
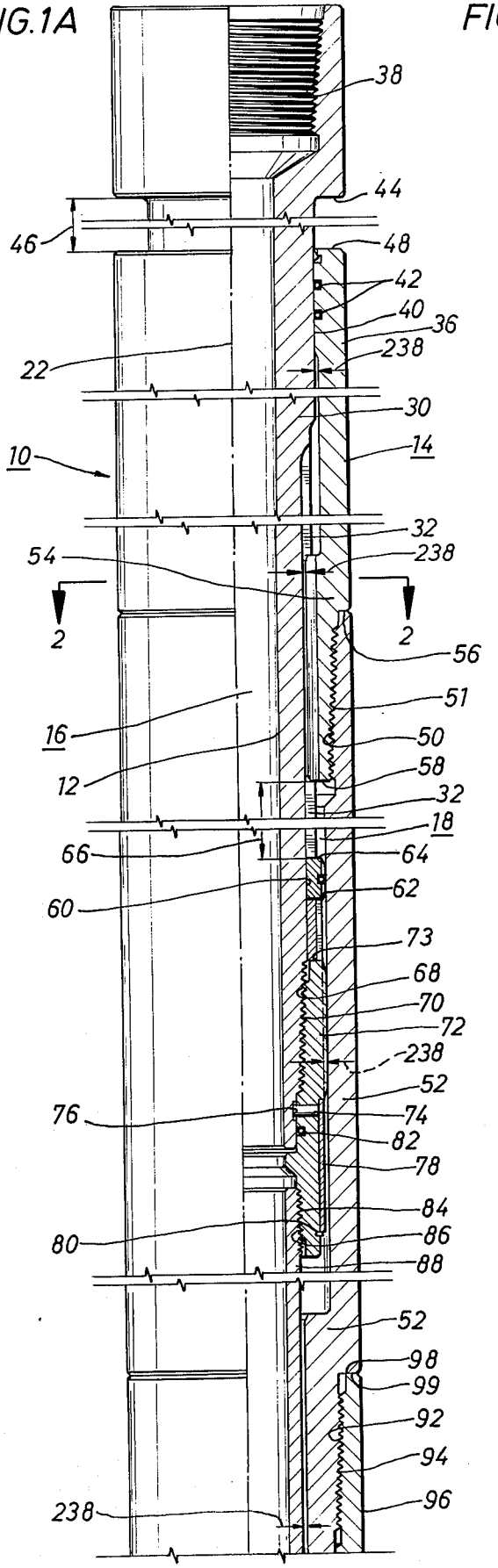

Throughout the following description, similar reference numerals refer to similar elements in all figures of the drawings.

Figure 1B:
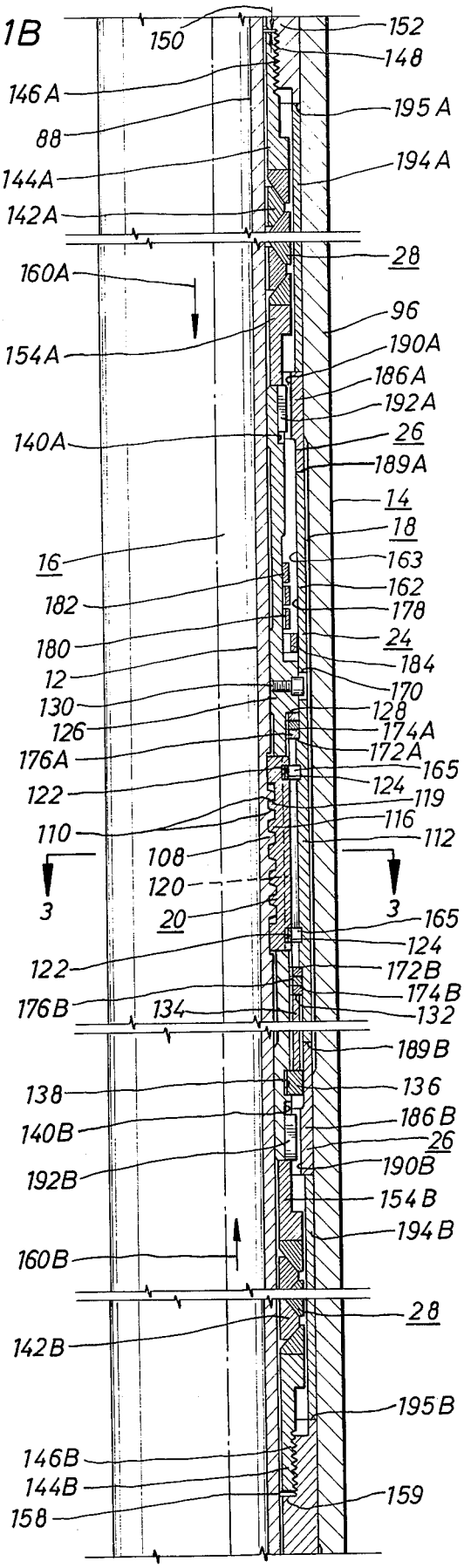

Referring to FIGS. 1A, 1B, and 1C, a well jar generally indicated by reference numeral 10 embodying the teachings of this invention is illustrated in logitudinal elevational views, partially in section, with the jar 10 being broken at appropriate portions thereon for convenience of illustration. As is well know to those skilled in the art, the jar 10 is utilized within a drill string extending into a well bore 11 in order to provide disengaging forces to cause disengagement of other portions of the drill string which are susceptible of being stuck within the bore. Such other portions may include, for example, the drill bit or any apparatus associated with the drilling operation. The jar 10 includes an elongated inner member, or mandrel, generally indicated by reference numeral 12, telescopically disposed within an elongated outer member or barrel, generally indicated by reference numeral 14. The mandrel 12 has a central axial channel 16 through which drilling fluid may be conducted during normal drilling operations. The outer surface of the inner mandrel 12 and the inner surface of the outer barrel 14 cooperate to define an enclosed annular volume 18 in which other elements of the well jar 10 are disposed. Included within the volume 18 and to be defined in more detail herein is latching means 20 for releasably engaging the inner mandrel 2 to prevent displacement thereof along a central axis 22 relative to the outer barrel 14. Latch release means 24 for releasing the latching means 20 from its engagement with the inner member 12 is rotatably disposed within the volume 18 in cooperative association with rotating means 26 for rotating the latch release means 24 and with resilient means 28 for biasing the inner member 12 to permit axial upwardly or downwardly displacement thereof only in response to an axial triggering force imposed on the inner member 12 exceeding a predetermined magnitude. The rotating means 26 are provided to rotate the release means 24 into a latch-releasing position which will be defined more fully herein.

As is apparent in the figures, both the inner mandrel 12 and the outer barrel 14 are each comprised of several axially extending, conjoined sections. Refering to FIG. 1A, the upper portion of the inner mandrel 12 is shown to include a spline mandrel 30 which is an elongated tubular member having axially integral sections of reducing diameter and having a plurality of axial splines 32 disposed over approximately the lower axial half thereof. The splines 32 are received within longitudinal grooves 34 (FIG. 2) provided within a barrel spine housing or driving sub 36, this last mentioned member being included as a portion of the barrel 14. As best seen in FIG. 2, which is a sectional view taken along lines II—II of FIG. 1A, the engagement of the splines 32 within the spline-receiving grooves 34 simultaneously serves to permit axial displacement of the nandrel 12 relative to the outer barrel 14 and also to transmit torque loads imposed upon the mandrel 12 from the appropriate driving means disposed on the surface (not shown) to the barrel 14 to effectuate normal drilling operations. For the purpose of facilitating connection of the inner mandrel 12 to the remainder of the drill string extending thereabove to the surface, a threaded connection 38 is provided in the axially upper portion of the spline mandrel 30.

A close sliding fit illustrated at 40 between the central portion of the spline mandrel 30 and the upper interior diameter of the barrel spline housing 36 is sealed from the entry of matter exterior to the jar 10 by the circumferencial provision about the interior diameter of the upper axial end of the barrel spline housing 36 of a plurality of O-rings or packings 42. The spline mandrel 30 has a downwardly facing annular shoulder or bumping hammer 44 defining a diametrical decrease of the spline mandrel 30, the shoulder 44 being spaced a predetermined axial distance 46 from an upwardly facing surface or bumping anvil 48 provided on the barrel spline housing 36. It may thus be appreciated that the inner mandrel 12 and the outer barrel 14 have provided thereon a first set of cooperatively facing impact receiving surfaces 44 and 48, the surfaces being spaced a predetermined axial distance 46 apart when the jar is in a unactuated or "neutral" disposition within the drill string, as shown in FIG. 1. It may be appreciated that axial displacement of the inner mandrel 12 relative to the outer barrel 14 in response to an axially directed impact-generating or triggering force imposed through the drill string to the mandrel 12 closes the predetermined axial spacing 46 between the shoulders 44 and 48 and generates a "bumping" impact therebetween useful to dislodge any engaged portion within the drill string. The inner mandrel 12 is permitted to respond to the axially imposed force through the release of the latching means 20 in a manner to be described more fully herein.

The barrel spline housing 36 is provided with threads 50 on its external diameter adjacent its lower end, which are received within threads 51 provided on the upper internal diameter of an upper barrel housing 52. Positive sealing between the barrel spline housing 36 and the upper barrel housing 52 is facilitated by compressive engagement between a shoulder 54 and an upper axial surface 56 on the upper barrel housing 52 due to the makeup of the threads 50 and 56. Radially inwardly of the upper barrel housing 52 axially below the threaded connection between threads 50 and 51, the barrel spline housing 36 presents a downwardly facing impact surface or jarring anvil 58.

Disposed about the spline mandrel 30, in circumferentially registering recesses or grooves 60 provided within the splines 32, is a split ring 62. The split ring 62 serves to prevent the inner member 12 from being axially withdrawable from within the outer barrel 14. As can be seen, as long as the outer barrel 14 is maintained in place, the split ring 62 prevents the mandrel 12 from being withdrawn from within the barrel 14 while the tool 10 is disposed within the well bore. It is also apparent from the drawings that the split ring 62 presents an upwardly facing impact surface or jarring hammer 64 spaced a predetermined axial distance 66 from the downwardly facing impact surface 58. It may again be appreciated therefore that a second set of impact producing surfaces 58 and 64 are, respectively, provided on the outer barrel 14 and the inner mandrel 12, these surfaces being spaced a second predetermined axial distance 66 apart. These surfaces 58 and 64, when engaged in response to an axially directed force on the inner member 12 produce a "jarring" force to dislodge any engaged portion of the drill string in a manner to be more fully explained herein.

Provided adjacent the lower axial end on the external diameter of the spline mandrel 30 are threads 68 which are received by threads 70 disposed on the upper inner diametrical surface of a mandrel head 72. The mandrel head 72 provides a close axial sliding clearance with the internal diameter of the upper barrel housing 52 so as to stabilize the inner member 12 with respect to the outer barrel 14. Positive threading engagement between the spline mandrel 30 and the mandrel head 72 is facilitated when the upper surface of the head 72 is axially abutted against the lower axial surface of a splined spacer 73, the upper surface of which shoulders against the split ring 62. A radially extending pin or lug 74 extends through the mandrel head 72 and into a slot or radial groove 76 provided in the spline mandrel 30 to guard effectively against any backing-off of the thread between mandrel portions 30 and 72. A retainer ring or sleeve 78 is retained by a key or retainer ring 80 to the outer diameter of the mandrel head 72 to secure the pin 74 from slipping radially from its hereinbefore described assembled relationship. An O-ring seal 82 is provided to insure further against the entry of drilling fluid from the interior channel 16 between the threadedly joined mandrel head 72 and the spline mandrel 30.

Threads 84 are provided on the inner diameter near the lower axial end of the mandrel head 72 and receive threads 86 provided on the exterior diameter of the upper axial end of a central mandrel portion or trip mandrel 88. Positive sealing for the threaded engagement of tapered threads 84 and 86 is facilitated by the interference fit between the tapered threads to thereby prevent entry of drilling fluid from the central channel 16 to the annular volume 18 defind between the inner mandrel 12 and the outer barrel 14. The lower portion of the upper barrel housing 52 is provided with threads 92 which are received by threads 94 provided on the upper interior diameter of a middle or central barrel housing 96. Positive fluid-tight sealing between the middle or central barrel housing 96 and the upper barrel housing 52 is facilitated by the threaded engagement between threads 92 and 94.

Referring to FIG. 1C, the lower axial end of the middle barrel housing 96 has provided on its interior diameter thereof threads 100 which receive threads 102 provided on the upper exterior surface of a lower barrel housing 104. Positive sealing is facilitated by maintaining the threaded engagement between threads 100 and 102 until the lower surface 105 of the central barrel housing 96 abuts against an upward facing shoulder 106 provided on the lower barrel housing 104.

Figure 5:
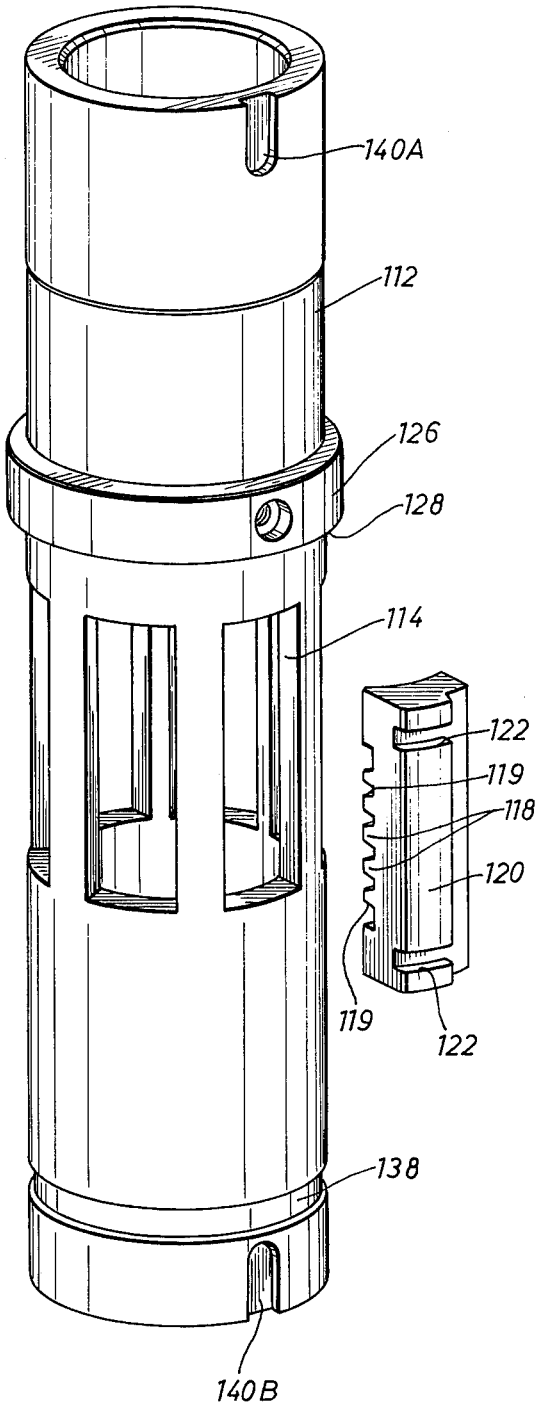

Referring to FIG. 1B, radially inward of the central portion of the middle barrel housing 96 the trip mandrel 88 has provided thereon a plurality of radial outwardly extending lands, or teeth 108, each land or tooth having inclined radially extending upper and lower surfaces 110 thereon. Disposed within the annular volume 18 concentrically with the trip mandrel 88 is a cylindrical trip sleeve 112. As best seen in FIG. 5, the trip sleeve 112 has a plurality of axially extending longitudinal openings or windows 114 therein, the windows 114 being spaced circumferentially apart a predetermined angular distance on the trip sleeve 112. Again as seen in FIG. 5, and FIG. 1B, received within each of the windows 114 in the trip sleeve 112 is a substantially arcuate trip segment 116.

Each trip segment 116 is restrained by the trip sleeve 112 against longitudinal and rotational motion relative to the central axis 22, but is free to move radially inward and outward within the trip sleeve 112 in response to forces imposed thereon during the trip release sequence to be described more fully herein. Each of the trip segments 116 disposes, on its radially inner surface, a plurality of lands 118, each land having an inclined radially extending surfaces 119 corresponding to the inclination of the surfaces 110 on the lands 108. As known to those skilled in the art, the inclination of the surfaces 110 and 119 must be large enough so that the resultant force generated by the surfaces is greater than the frictional force acting on the trip segment to prevent the outward movement thereof. However, the inclination must not be so large so that the resultant force causes excessive wear on the outer trip surfaces. Further, the radially outward surfaces of each segment 116 has a radially extending portion 120 thereon. Also machined into the radially outward surface of each of the segments 116 are grooves 122 which receive split C-rings 124, the C-rings 124 acting to provide a radially inwardly directed force on the trip segments 116. It is apparent that imposition of an axial force on the inner member 12 will be resolved into a radially outwardly directed component through the cooperating inclined surfaces 110 and 119 so as to provide a force urging the trip segments 116 radially outwardly with respect to the inner mandrel 12 when an axially directed force is imposed on the inner member 12.

The trip sleeve 112 has a downwardly facing shoulder provided on its radially outer surface axially above the trip segments 116. An enlarged diametrical portion 126 on the sleeve 112 defines shoulder 128 which extends beyond the basic diameter of the trip sleeve 112. Secured into the diametrically extending portion of the trip sleeve 112 is a set screw 130 the head of which extends radially beyond the enlarged diametrical portion 126 of the trip sleeve 112. An upwardly facing shoulder 132 is provided adjacent the axially lower end of the trip segments 116 by the upper axial surface of a sleeve 134 which surrounds the trip sleeve 112 to effectively enlarge its basic diameter, the sleeve 134 being held in place by a ring 136 set within a groove 138 disposed within the lower axial portion of the trip sleeve 112.

As may be appreciated from the figures, the trip segments 116, with their inwardly projecting lands 118 engaging the lands 108 on the central mandrel 88 comprise the latching means 20 generally alluded to earlier. When engagement between the lands 108 and the lands 118 is extant, that is, is currently or actually existing, relative motion between the inner mandrel 12 and the outward barrel 14 is prevented, thus preventing any closure of the axial distances 46 or 66 to prevent impact-producing or (i.e., "bumping" or "jarring") contact between the sets of impacting surfaces 44 and 48 or 58 and 64.

The axially upper end lower ends of the trip sleeve 112 has slots 140A and 140B, respectively, cut on its radially outward surface. Axially above and below the trip sleeve 112 and disposed within the annular volume 18 is the resilient means 28 which comprises a ring spring indicated by reference numerals 142A as the upper end 142B as the lower resilient means, respectively. The ring springs 142A and 142B are able by their construction to provide a high biasing force in the neighborhood of 200,000 pounds and impose this bias force in an appropriate direction tending to oppose the imposition of an axially directed triggering force on the inner member 12. Thus, the disposition of the ring springs 142A and 142B prevent the premature triggering of the jar 10.

It may be seen from the figures that the upper ring spring 142A is retained within the annular volume 18 by an upper spring retainer 144A. The upper spring retainer 144A is provided with threads 146A near its upper axial end on the outer diameter thereof which are received within threads 148 provided on the interior diameter of the lower axial end of the upper barrel housing 52. As may be appreciated, the magnitude of the biasing force exerted on the trip sleeve 112 by the upper ring spring 142A may be effectively regulated by the degree of threaded overlap between threads 146A and 148, or alternatively, by the axial clearance 150 extant between the upper axial end of threads 146A and a shoulder 152 defined on the interior diameter of the upper barrel housing 52. The lower terminus of the upper ring spring 142A abuts against and transmits its force into the upper terminus of the trip sleeve 112 through a loading sleeve 154A. A.

Looking to the lower ring spring 142B, structures similar to that described hereinbefore for the upper ring spring 142A is provided. Thus, a lower spring retainer 144B, provided with threads 146B, is received within threads 156 provided on the interior diameter of the upper axial end of the lower barrel housing 104. The magnitude of the biasing force due to the spring 142B is effectively regulated by the degree of overlap between threads 146B and 156, or, alternatively, the the axial clearance 158 extant between the lower axial end of threads 146B and a shoulder 159 defined on the interior diameter of the lower barrel housing 104. The upper end of the lower ring spring 142B abuts and transmits force to the lower end of trip sleeve 112 through a loading sleeve 154B.

It may thus be appreciated that the resilient ring springs 142A and 142B are retained at one axial end thereof within the annular volume 18 against the retainers 144 which themselves are threadedly braced against a portion of the outer barrel member 14, while the second end of the ring springs act, through sleeves 154, on the trip sleeve 112. Any force axially on the inner mandrel 12 is prevented from displacing that mandrel 12 relative to the outer barrel 14 through the cooperation of the engaged lands 108 and lands 118. Further, any force imposed on the inner mandrel 12 must be of a magnitude sufficient to overcome bias force imposed by the ring springs 142 acting in directions 160A and 160B, respectively, before the latch means 20 is released from its locking position with the inner mandrel 12.

The latch release means 24 includes a substantially cylindrical sleeve member or rotating sleeve 162 rotatably disposed within the annular volume 18 and radially inward adjacent to the central barrel portion 96 and radially outward adjacent to the trip sleeve 112 having trip segments 116 therein. As seen in FIG. 1B, in conjunction with FIG. 3A, the rotating sleeve 162 has a plurality of axially extending openings, or grooves 164 disposed along the inner surface thereof. The grooves 164 are sized to receive the extending portions 120 of the trip segments 112, but, as seen, when in the latching position in FIG. 3A, the extending portions 120 of the segments 116 radially abut against the interior surface 163 of the rotating sleeve 162 while the grooves 164 are displaced a predetermined angular distance from registration with the extending portions 120. An angular distance of approximately 15° is utilized for the misalignment of the openings 164 with the extending portions 120, although other angular displacements may be used. It may also be seen from examination of FIG. 3A that until complete registration of the grooves 164 with the extending portions 120 is provided, the extending portions 120 maintain contact with the surface 163 of the sleeve 162 and therefore engagement between the lands 118 and the lands 108 remains intact. As may further be appreciated, that once rotation of the rotating sleeve 162 is a predetermined angular direction 166 occurs to bring the grooves 164 into complete registration with the extending portions 120, the segments 116 respond to forces imposed thereon by the urging means (the inclined surfaces 110 and 119, respectively, on the lands 108 and the lands 118) to cause the segments 116 to snap radially outwardly and to simultaneously engage the extending portions 120 with the grooves 164 and to release the lands 118 from their locked engagement with the lands 108.

Figure 4:
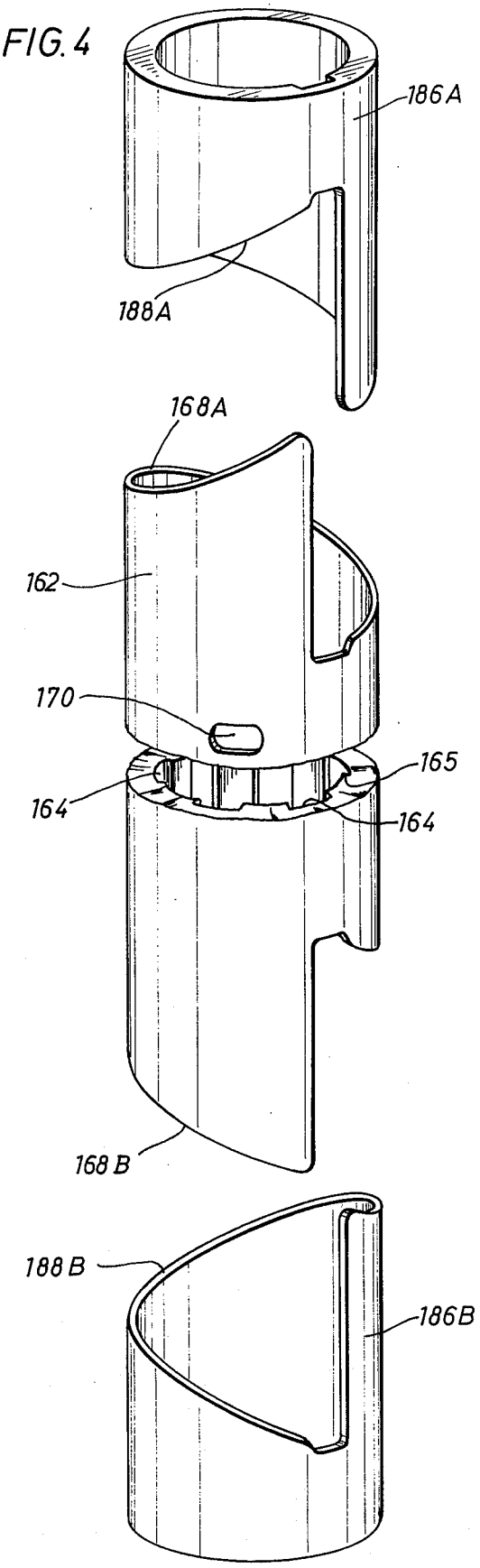
FIG. 4 is an exploded, perspective view of the camming interactions of the latch release member and cam sleeve elements embodied within the invention; and, FIG. 5 is an exploded perspective view of the trip sleeve and trip segment elements embodied within the invention.

As viewed in FIGS. 4 and 1A, the rotating sleeve 162 terminates in first and second camming surfaces 168A and 168B. The rotating sleeve 162 has a slot 170 provided therein into which slot 170 the head of the pin 130 extends. The engagement of the slot 170 with the head of the pin 130 effectively prevents rotation of the sleeve 162 beyond a certain predetermined angular distance. As further seen in FIG. 1B, the rotating sleeve 162 has on its inner surface, upward and downward facing shoulders 172A and 172B, respectively. The upwardly facing shoulder 172A cooperates with the downwardly facing shoulder 128 on the trip sleeve 116 to define an annular volume 174A. The downwardly facing shoulder 172B cooperates with the upwardly facing shoulder 132 to define a second annular volume 174B therebetween. Force transmission means 176A and 176B are respectively disposed within an annular volumes 174A and 174B. In FIG. 1B, the force transmission means are shown as stacked thrust washers. It may be clearly understood that any axial displacement of the combined inner mandrel 12 with the latching means 20 against the bias force of the resilient means 28 imposes a force associated with that displacement through the force transmission means 176 into the rotating latch release means 24 exemplified by the rotating sleeve 162. Disposed in an annulus 178 disposed between the outer surface of the trip sleeve 112 and the inner surface of the rotating sleeve 162 is a torsion spring 180 the first axial end of which is secured, as at 182, to the trip sleeve 112 while the second axial end is secured as at 184 to the inner surface of the rotating sleeve 162. The torsion spring 180 acts to restore the rotating sleeve 162 to its unactuated position by urging the sleeve 162 to displace angularly, in a direction opposite the predetermined direction of rotation 166, when the axially imposed triggering force on the inner member 12 is released. Thus, repeated impact-producing forces in either axial direction may be imposed upon the inner member 12 to generate impact-producing contact between the corresponding surfaces on the inner and outer members to disengage any device stuck within the well bore and attached along the drill spring. The rings 124 fit within the openings or grooves 164 provided within the sleeve 162 as follows: as the trip segments 116 move outwardly, the C-rings 124 are expanded. When the portion 120 is received within the groove 164, the C-ring 124 is expanded outward to pass the interior surface 163 of the rotating sleeve 162, to move into radial grooves 165 provided in the rotating sleeve 162.

The means 26 for rotating the latch release 24 comprise upper and lower cam sleeves 186A and 186B respectively. As seen in FIG. 1B and in FIG. 4, the sleeves 186A and 186B are respectively provided with camming surfaces 188A and 188A which engage camming surfaces 168A and 168B, respectively, a predetermined overlapped amount as at 189A and 189B in FIG. 1B. By overlapped, it is meant that the cam surfaces 168 and 188 are engaged in a camming relationship along camming interfaces 189. The sleeves 186A and 186B have grooves or keyways 190A and 190B therein which respectively register with slots 140A and 140B provided on the exterior diameter of the trip sleeve 112. These last mentioned registered slots define a channel into which keys 192A and 192B are disposed in order to prevent rotation between the cam sleeves 186 and the trip sleeve 112. It will, however, be appreciated that axial displacement of the trip sleeve 112 is permitted on key 192 relative to the cam sleeves 186. The cam sleeves 186 are braced axially against movement relative to the outer barrel 14 by spacer sleeves 194A and 194B which respectively abut against the lower axial end of the upper barrel housing 52 and the upper axial end of the lower barrel housing 104, as shown at 195A and 195B, respectively.

It may be appreciated that the cam sleeves 186 are both rotationally and axially stationary relative to the rotating sleeve 162. The only criteria relevant to the disposition of the overlap camming surfaces 168 disposed on the rotating sleeve 162 and the camming surfaces 188 disposed on the cam sleeves 186 is that imposition of an axially directed force into the rotating sleeve 162 generates a camming reaction along the overlapped cam surfaces 189 to rotate the rotating sleeve 162 in a only one predetermined angular direction. The respective overlapped camming surfaces 189 may either be right-handed or left-handed camming surfaces depending upon the particular circumstances of each application or as desired, but it is understood that the camming surfaces are disposed such that the rotating sleeve 162 is impelled to rotate about the axis 22 only in one predetermined angular direction due to the camming action therebetween in response to either an axially upwardly or downwardly directed triggering force. Further, the torsion spring 180 generates a resetting force acting only in a direction opposite the direction which the rotating sleeve 162 is urged by the interaction of the cam surfaces.

Referring now to FIG. 1C, the lower axial end of the central mandrel 88 has threads 208 disosed on the exterior diameter thereof which are received by threads 210 provided on the interior diameter of a wash pipe 212. Positive fluid-tight sealing between the central mandrel 88 and the wash pipe 212 is facilitated when the threaded engagement 208–210 is sufficient to place the lower surface 213 of the central mandrel portion 88 and a shoulder 214 on the wash pipe 212 into axially abutting contact. Thus, escape of drilling fluid from the central channel 16 of the inner mandrel 12 is effectively prevented. In recapitulation, it may be appreciated that the inner mandrel 12 comprises the axially threaded engagement of an upper spline mandrel 30 threaded through a mandrel head 72 to a central mandrel portion 88, which is in turn threaded to a wash pipe portion 212. The central channel 16 is defined axially through the entire length of the inner mandrel 12, as discussed hereinabove.

The lower barrel housing 104 has threads 216 disposed on the inward diameter adjacent the lower axial end thereof. The threads 216 receive threads 218 provided on the exterior diameter adjacent the upper axial end of bottom sub 220. Positive fluid-tight seal engagement between the lower mandrel housing 104 and the bottom sub 220 is facilitated when the threaded engagement 216–218 provides an abutting interface between the lower axial end 221 of the lower barrel housing 104 and a shoulder 222 provided on the exterior diameter of the bottom sub 220. The bottom sub 220 has external threads 224 thereon which may be received within a variety of drilling tools, such tools either directly or ultimately connected to a drilling bit for use in generating the well bore. Thus, to recapitulate, the outer barrel member 14 comprises the axially conjoined arrangement including the barrel spline housing 36 threadedly connected through the upper barrel housing 52 into the central barrel housing 96. The central barrel housing 96 is itself threaded through the lower housing 104 into the bottom sub 220. Also associated with the outer barrel 14 for the purposes of maintaining the resilient means and the rotating means stationary with respect to the outer barrel 14 are the spring retainers 144 and the cam sleeves 186 and their associated spacer elements 194.

To prevent the passage of drilling fluid from the inner central channel 16 radially between the wash pipe 212 and the interior diameter of the bottom sub 220, a packing 226 is provided. The packing is maintained in position by a plug 228 threadably engaged through threads 230 disposed thereon with threads 232 disposed on the interior diameter of the axially upper end of the lower sub 220. Further, a circumferencially disposed scraper ring 2345 is provided between the plug and the circumference wash pipe 212. The packing 226 is further maintained in position by stabilizer sleeves 236A and 236B which also provide stabilization between the inner mandrel 12 and the outer barrel 14.

As is appreciated by those skilled in the art, disposed within the annular volume 18 defined between the inner mandrel 12 and the outer barrel 14 is a suitable lubricant fluid, such as oil, which provides lubrication for the relatively moving parts above-mentioned and which further provides a medium in which a pressure may be maintained in order to resist radial jamming of the relatively moving parts which could result from the pressure differential .between the drilling fluid coursing through the interior channel 16 of the jar 10 and well mud disposed on the exterior of the barrel 14 within the bore. It may be appreciated that since the annulus 18 is enclosed, and since relatively moving parts are provided therewithin, suitable flow space must be provided so as to permit the lubricant oil to be displaced within the annular volume 18.

For this purpose, throughout the axial lenth of the jar 10, there is provided lubricant fluid gaps or clearances 238 between the elements comprising the jar herein described.

In order to pressure-equalize the lubricating fluid within the volume 18 and the pressure of the well fluid or mud external to the drill jar 10, a separator piston or float 240 is provided which is axially movable within a zone 242 defined radially by the interior of the lower barrel housing 104 and the exterior or the central mandrel 88 and axially by a shoulder 244 provided on the interior of the lower housing 104 and an upper surface 246 provided on the wash pipe 212. The separator piston is provided with O-ring seals 248 to prevent fluid flow therearound. The upper surface 250 of the float 240 therefore communicates with the lubricating fluid disposed within the annular volume 18 while the lower surface 252 thereof communicates with a zone 254 defined radially by the interior surface of the lower barrel housing 104 and the exterior surface of the wash pipe 212, and axially a surface 256 on the plug 228 and the lower surface 252 of a separator or plug 240. A mud port 258 is provided radially through the lower barrel housing 104 and permits communication between the zone 254 and the exterior of the jar 10. It may be appreciated that well mud may enter through port 258 and the pressure thereof be transmitted to the lower surface 252 of the float 240 in order that pressure equalization between the lubricant fluid within the annular volume 18 and the well mud be maintained.

In operation, it being assumed for purposes of the following discussion that the drilling tool or engaged device is disposed in threaded attachment to the outer barrel 14 comprising the above-identified axially-conjoined parts. In practice, it may occur that a portion of the drill string connected to the outer barrel 14 becomes engaged within the well and further advancement of the drill string is therefore precluded. At this point in the drilling operation it becomes necessary to impose an axial impactive force on the jar 10 in order to disengaged the trapped portion of the drill string so that normal operations may be resumed.

The drill jar 10 embodying the teachings of this invention is responsive either to an axially compresive or an axially tensive force imposed on the inner member 12 in order to trigger the drill jar to produce a downwardly directed "bump" or an upwardly-directed "jar" respectively, depending upon the direction of axially imposed force on the inner member.

If the situation requires that a downward-directed bump be imposed upon engaged drilling element, an axially directed compressive force is imposed through the drill string and its connection 38 to the inner member 12. It is apparent that the engaged lands 108 and lands 118 respectively provided on the inner mandrel 12 and the latching segments 116 prevent relative displacement between the inner member 12 and the other member 14 and maintain the spacing 46 between the opposed impacts surfaces 44 and 48. It is also apparent that the downward compressive force acting on the inner member 12 is effectively opposed by an upwardly directed bias force from the ring spring 142B acting in direction 160B imposed through the trip sleeve 112 into the segments 116 to prevent displacement of the engaged members unless the compressive force imposed upon the inner member 12 is sufficient to overcome the bias force. This, premature tripping of the jar is prevented.

Assuming that a sufficient axial force having a predetermined magnitude is compressively imposed upon the inner member 12, the urging means comprising the engaged surfaces 110 and 119 of the lands 108 and the lands 118, respectively, are actuated to provude a radially outwardly directed force on the trip segments 116. However, as seen in FIG. 3A, the abutment between the extending portion 120 and the interior surface 163 of the rotating sleeve 112 prevents the segments 116 from moving radially outwardly in response to the urging force. The combined arrangement of the inner mandrel 12 and the segments 116 therefore displace axially to compress the lower resilient spring 142B. This displacement of the trip segments 116 and trip sleeve 112 is transmitted through the force transmission means 176 into the rotating sleeve 162. Depending upon the degree of preset overlap engagement between the camming surfaces 188 and 168, respectively provided on the cam sleeves 186 and the rotating sleeve 162, imposition of an axially directed force imposed through the force transmission means 176A into the rotating sleeve 162 causes rotating sleeve 162 to rotate a predetermined angular distance in direction indicated by arrow 166 on FIG. 3A to place in radial registration the grooves 164 with the extending portions 120 provided on the trip segments 116. Once complete radial registration between the grooves 164 and the extending portions 120 occurs, the trip segments 116 respond to the radially outwardly directed urging force imposed by the inclined surfaces 110 and 119 thereon to snap the segments 116 radially outwardly to simultaneously engage the extending portions 120 thereon with the grooves 164 disposed on the rotating sleeve 162. Simultaneously with the engagement, as best seen in FIG. 3B, the lands 108 and 118, respectively, disengage to permit the inner member 12 to respond to the axially compressive force to drive impact surfaces 44 and 48 into a bump-producing impact.

Upon release of the axially compressive force, the torsion spring 180 imposes on the sleeve 162 a biasing force in a direction opposite to the direction of rotation 166. Surfaces 165 (FIG. 3A) defining the grooves 164 and surfaces 121, (FIG. 3A) provided on the extending portion 120, in conjunction with the split rings 112, impose a radially inwardly directed force on the segments 116 to cause re-engagement between the lands 108 and the lands 118, when the mandrel 12 is biased back to its latched position. Thus, jar 10 is in position to be repetitively operated in order to impose sufficient impact-producing forces on the drill string. The angles of inclination for the surfaces 121 and 165 may be any suitable angle, such as 30°.

It circumstances dictate that a tensile force be imposed upon the inner mandrel 12, the engaged lands 118 and lands 108 similarly prevent axially displacement thereof against the biasing force of the upper spring 142A acting in direction 160A. In a manner similar to that discussed hereinbefore, a sufficient axially tensile force on the inner member 12 is transmitted through the engaged lands 108 and lands 118 and through the force transmission means 176B into the rotating sleeve 162 to cam the sleeve 162 about overlapped surfaces 168A and 188A. Thus, the grooves 164 therein are placed into registration with extending portions 120.

Rotation of the sleeve 162 so as to completely register the grooves 164 with the extending portions 120 permits the segments 116 to snap radially outwardly in response to the forces imposed thereon through the engaged surfaces 110 and 119 to permit the inner member 12 to respond to the axially tensile force imposed thereon and to displace a predetermined axial distance 66 so as to drive the impact surface 64 into an impact, or jar-producing, contact with the surface 58.

It is apparent that the degree of axial displacement of the combined segment 116 and inner mandrel 12 necessary to cam the rotating sleeve 162 about the axis 22 to bring into registry the grooves 164 therein with the extending portions 120 is dependent upon the amount of predetermined overlap provided between thhe engaged cam surfaces 168 and 188.

It should also be appreciated that a well jar embodying the teachings of this invention operate in the same manner even if inverted in its connection within the drill string. I.e., a compressive force is still required to produce a "bumping" and a tensile force is still required to generate a "jarring."

It may thus be appreciated that a well jar combining both radially outward and rotational motion of members disposed therewithin to disengage one axially telescoped member relative to another to drive impact surfaces disposed thereon into a force producing contact to disengage objects attached to the jar from entrapment within the well bore has been provided by a jar embodying the teachings of this invention.

What is claimed is:

1. A well jar comprising:

first and second telescoped members each having an impact surface, said second member engageable to a device susceptible of being stuck, a resilient member associated with said first member and compressible only in response to a force on said first member exceeding a predetermined magnitude, latching means having an extending portion coupled with said resilient member for releasably preventing displacement of said first member relative said second member, biasing means for biasing said latching means away from said displacement preventing relationship, release means having an opening sized to receive said extending portion and rotatable relative said first member for releasing said latching means, and, means for transmitting forces imposed on said first member to said release means, said resilient member being compressible to impose a force through said transmission means to said release means, said release means being rotatable to register said opening therein with said extending portion, said latching means being radially displaceable responsive to said biasing means to simultaneously engage said extending portion within said opening and to release said first member, said first member being axially displaceable to drive said surfaces into impact-producing contact.

2. The well jar of claim 1, wherein said release means has a camming surface thereon, and further comprising:

a cam member rotatably and axially stationary relative said release means, said cam member engaging said camming surface on said release means a predetermined degree, said release means responsive to an axially directed force transmitted thereto to generate a camming action along said engaged surfaces to rotate said release means in a predetermined angular direction.

3. The well jar of claim 2, further comprising:

a second impact surface disposed on said first member and on said second member, and wherein said first member is axially displaceable in a first axial direction to drive said first surfaces into a first impact-producing relationship and in a second axial direction to drive said second surfaces into a second impact-producing relationship.

4. The well jar of claim 3, wherein said release means has a second camming surface thereon, and further comprising:

means for rotating said relase means in a direction opposite said predetermined angular direction to release said extending portion therefrom and to reestablish said displacement-preventing relationship between said latching means and said first member, and, a second cam member rotatably and axially stationary relative said release means, said second cam member engaging said camming surface on said release means a predetermined degree, said release means responsive to an axially directed force transmitted thereto in a direction opposite said first axially directed force to generate a camming action along said second engaged surfaces to rotate said release means in said predetermined angular direction.

5. The well jar of claim 4, wherein said first member is radially inwardly disposed of said second member; and, said first member is responsive to a force acting in a first axial direction to drive said first surfaces into a first impart-producing contact.

6. The well jar of claim 5, wherein, said release means is responsive to said rotating means to rotate opposite said predetermined angular direction to reestablish said displacement-preventing relationship between said first member and said latching means; and, said first member is responsive to a force acting in a second axial direction to rotate said release means in said predetermined angular direction to drive said second surfaces into a second impact-producing contact.

7. The well jar of claim 4, wherein said first member is radially outwardly disposed of said second member; and, said first member is responsive to a force acting in a first axial direction to drive said first surfaces into a first impact-producing contact.

8. The well jar of claim 7, wherein, said release means is responsive to said rotating means to rotate opposite said predetermined angular direction to reestablish said displacement-preventing relationship between said first member and said latching means; and, said first member is responsive to a force acting in a second axial direction to rotate said release means in said predetermined angular direction to drive said second surfaces into a second impact-producing contact.

9. The well jar of claim 4, wherein said resilient member comprises a ring spring.

10. A well jar comprising:

an inner member having an impact surface thereon, an outer member axially displacable relative to said inner member and having an impact surface thereon spaced a predetermined distance from said impact surface on said inner member, a latching member releaseably engaged with said inner member to lock said inner member relative to said outer member to prevent relative motion therebetween, said latching member having an extending portion thereon, a latch release member rotatably disposed with respect to said inner member and having an opening therein sized to receive said extending portion of said latching member, a resilient member associated with said latching member to bias said latching member against displacement in response to the imposition of a force less than a predetermined magnitude imposed on said first member, means for urging said latching member radially outwardly from said first member when a force greater than a predetermined magnitude is imposed thereon, and, means for transmitting a force imposed on said inner member to said latch release member, said latch release member being rotatable in response to a force transmitted thereto to rotate in a predetermined angular direction to dispose said opening therein in registration with said extending portion to simultaneously engage said opening to release said inner member to permit said inner member to displace in response to said axially directed force thereon and to bring said impact surfaces into an impact producing engagement.

11. The well jar of claim 10, wherein said latch release member has a camming surface thereon; and, further comprising a cam sleeve having a camming surface thereon, said camming surface on said cam sleeve engaging said camming surface on said release member to a predetermined degree.

12. The well jar of claim 11, wherein said inner member has a tooth with an inclined surface thereon, said latching member has a land with inclined surfaces thereon, and wherein said urging means comprise the engage inclined surfaces, said urging means able to transform an axial force imposed on said inner member to a radially outwardly directed force on said latching member.

13. The well jar of claim 11, further comprising:

torsion spring means for rotating said release member in a direction opposite said first angular direction to reengage said latching member with said inner member.

14. The well jar of claim 11, wherein said resilient member is a ring spring.

15. A well jar comprising:

a first and a second member, said first and said second members each having an impact surface, said impact surfaces being cooperable when forceably brought into contact to provide an impact along an axis of said first and second members;

first biasing means for urging said first and second members towards a position of maximum separation of said respective impact surfaces;

latching means for maintaining said first and said second members in a latched position of maximum separation of said respective impact surfaces, said latching means comprising:

a rotatable sleeve having an inner surface and at least one opening therein;

a tripping member having engaging teeth on a first side thereof, said engaging teeth being engageable with said first member for maintaining said tripping member and said first member in a relatively immovable relationship, and an extending portion on a second side thereof, said extending portion being cooperable with said rotatable sleeve to lock said engaging teeth together with said first member when said extending portion engages the inner surface of said rotatable sleeve and to unlock said engaging teeth from said first member when said extending portion moves radially outwardly to engage the opening in said rotatable sleeve;

a first camming surface on said tripping member for urging said tripping member radially outwardly when an external axial force is imposed on said first and said second members; and, a second camming surface on said rotatable sleeve for rotating said rotatable sleeve when an external axial force is imposed on said first and said second members;

said first and said second camming surfaces being arranged, when an external axial force in excess of a force imposed by said first biasing means is imposed on said first and said second member, to urge said extending portion radially outwardly and to rotate said rotatable sleeve to bring said opening into registry with to thereby engage said extending portion to unlock said first member to enable said impact surfaces to forceably come into contact.

16. The well jar of claim 15 and further comprising:

second biasing means for urging said rotatable sleeve in an angular direction having a sense opposite that provided by said second camming surface when the external axial force is imposed.

17. The well jar of claim 16, wherein said first biasing means comprises a ring spring, and said second biasing means comprises a torsion spring.

18. A well jar comprising:

an inner member, a latching member having an extending portion thereon, means for locking said inner member and said latching member to prevent relative motion therebetween, means for urging said latching member away from said inner member when a predetermined force is imposed on said inner member, a latch release member rotatably disposed relative to said inner member and adjacent to said latching member, said latch release member having a recess therein sized to receive said extending portion of said latching member, and means for rotating said latch release member through a predetermined angular distance in a predetermined direction about an axis of rotation to bring said recess into registration with said extending portion when a predetermined force is imposed upon said inner member, said latching member respondable to a force imposed thereon by said urging means to displace away from said inner member to simultaneously disposed said extending portion within said recess and to disengage said locking means to enable said inner member to displace relative to said latching member in response to a force imposed on said inner member.

19. The well jar of claim 18, wherein said inner member has an impact surface thereon, and further comprising:

an outer member concentrically disposed relative to said inner member, said outer member having an impact surface thereon spaced a predetermined axial distance from said impact surface on said inner member, said outer and inner members combining to define an annular volume therebetween, and resilient means disposed in said volume for biasing said locked inner member and said latching member against displacement relative to said outer member in response to an axial force imposed on said inner member of less than a predetermined magnitude.

20. The well jar of claim 19, wherein said latch release member has a camming surface thereon, said means for rotating said latch release member comprises a cylindrical member having a camming surface thereon, said camming surfaces being engaged to a predetermined degree, said cylindrical member being both rotationally and axially stationary with respect to said latch release member, and further comprising:

first force transmission means for transmitting forces imposed on said inner member through said latching member to said latch release member, said locked inner member and latching member displaceable against said biasing force of said resilient means in response to the imposition of an axial force greater than a predetermined magnitude on said inner member, said force transmission means being actuated by the displacement of said locked inner member and latching member to transmit a force associated with the displacement of said locked members to said latch release member to generate a camming action between said engaged camming surfaces to thereby rotate said latch release member about said axis in a predetermined angular direction, rotation of said latch release means disengaging said locking means and enabling said inner member to displace axially relative to said outer member to bring said impact surfaces into impact-producing contact.

21. The well jar of claim 20, wherein said inner member has a second impact surface thereon, said outer member has a second impact surface thereon spaced a second axial distance from said second impact surface on said inner member and further comprising:

second resilient means disposed in said volume for biasing said locked inner member and latching member against displacement relative to said outer member in response to a second axial force imposed on said inner member of less than a predetermined magnitude, and second means for rotating said latch release member through a second predetermined angular distance in said predetermined direction about said axis so as to bring said recess into registration with said extending portion of said latching member when a second axial force greater than a predetermined magnitude is imposed on said inner member, said latching member responsive to a force imposed thereon by said urging means to displace away from said inner member to simultaneously dispose said extending portion thereof within said recess and to disengage said locking means to enable said inner member to displace relative to said latching member in response to a second force imposed on said inner member.

22. The well jar of claim 21, wherein said latch release member has a second camming surface thereon, said second means for rotating said latch release member comprises a second cylindrical member having a second camming surface thereon, said second camming surfaces being engaged to a second predetermined degree, said second cylindrical member being both rotationally and axially stationary with respect to said latch release member, and further comprising:

second force transmission means for transmitting forces imposed on said inner member through said latching member to said latch release member, said locked inner member and latching member displaceable against said second biasing force of said second resilient means in response to the imposition of a second axial force greater than a predetermined magnitude on said inner member, said second force transmission means responsive to a second displacement of said locked inner member and latching member to transmit a second force associated with the second displacement of said locked members to said latch release member to generate a second camming action between said second overlapped camming surfaces to thereby rotate said latch release member about said axis in said angular direction, rotation of said latch release member disengaging said locking means and enabling said inner member to displace axially relative to said outer members to bring said second impact surfaces into impact-producing contact.

23. The well jar of claim 22, further comprising:

a trip sleeve member disposed within said volume and supporting said latching member, said trip sleeve having a first and a second shoulder thereon, and wherein, said latch release member has a first and a second shoulder thereon, said first force transmission means being disposed between said first shoulders on said trip sleeve member and on said latch release member and comprising at least one generally annular thrust washer, said second force transmission means being disposed between said second shoulders on said trip sleeve member and on said latch release member and comprising at least one generally annular thrust washer.

24. The well jar of claim 22, further comprising:

means for turning said latch release member in a direction opposite said angular direction to reestablish said predetermined degree of engagement between said camming surfaces and to separate said impacted surfaces to reestablish said predetermined axial distance therebetween.

25. The well jar of claim 24, further comprising:

means for moving said latching member into locking engagement with said inner member, said moving means able to act simultaneously with said turning means to reestablish said locked engagement when said predetermined axial distance is reestablished.

26. The well jar of claim 18, wherein said inner member comprises a cylindrical mandrel having a plurality of circumferential teeth disposed thereon, said latching member has a plurality of lands disposed on a surface thereof opposite the surface having said extending portion thereon, and said locking means comprises the engagement between said teeth and said lands to prevent relative motion between said mandrel and said latching member.

27. The well jar of claim 18, wherein said latch release member has a camming surface thereon.

28. The well jar of claim 27 wherein, said first means for rotating said latch release member comprises a cylindrical member having a camming surface thereon, said camming surface on said cylindrical member being disposed in axial adjacency to and engaged to a predetermined degree with said camming surface disposed on said latch release member, said cylindrical member being rotationally and axially stationary relative to said latch release member so that a force transmitted to said latch release member cams said latch release member into rotation about said axis.

29. The well jar of claim 26, wherein each of said plurality of lands and each of said plurality of teeth have correspondingly inclined surfaces thereon, and, said urging means comprising the cooperative association between said inclined surfaces such that an axially directed force imposed on said mandrel is resolvable into a radially outwardly directed component to urge said latching member radially outwardly.

30. The well jar of claim 18, wherein said predetermined angular distance is 15°.

31. The well jar of claim 19, wherein said resilient means comprises a ring spring.

32. The well jar of claim 21, wherein said first and second resilient means each comprises a ring spring.

* * * * *